US006776646B2

(12) United States Patent
Lee

(10) Patent No.: US 6,776,646 B2
(45) Date of Patent: Aug. 17, 2004

(54) ELECTRICAL CONNECTOR ASSEMBLY HAVING LOCKING MEMBER

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/301,221

(22) Filed: Nov. 20, 2002

(65) Prior Publication Data

US 2004/0082215 A1 Apr. 29, 2004

Related U.S. Application Data

(63) Continuation-in-part of application No. 10/280,515, filed on Oct. 24, 2002, now Pat. No. 6,585,537.

(51) Int. Cl.[7] ..... H01R 13/327
(52) U.S. Cl. ..... 439/357
(58) Field of Search ..... 439/357, 358, 439/361, 362, 368

(56) References Cited

U.S. PATENT DOCUMENTS 5,154,629 A * 10/1992 Carver et al. ..... 439/352
5,716,228 A * 2/1998 Chen ..... 439/358
5,727,963 A * 3/1998 LeMaster ..... 439/358
5,775,931 A * 7/1998 Jones ..... 439/358
5,941,726 A * 8/1999 Koegel et al. ..... 439/358
5,971,790 A * 10/1999 Rohde ..... 439/357
6,056,578 A * 5/2000 Lin ..... 439/358
6,099,339 A * 8/2000 Yanagida et al. ..... 439/358
6,132,234 A * 10/2000 Waidner et al. ..... 439/358
6,146,205 A * 11/2000 Lai ..... 439/610
6,149,451 A * 11/2000 Weber ..... 439/358
6,322,387 B2 * 11/2001 Kawamae et al. ..... 439/358
6,585,536 B1 * 7/2003 Wu ..... 439/358

* cited by examiner

*Primary Examiner*—Tulsidas C. Patel
(74) *Attorney, Agent, or Firm*—Wei Te Chung

(57) ABSTRACT

An electrical connector assembly (100) comprises a cable end connector (1) and a complementary connector (7) mated with the cable end connector. The cable end connector includes a locking member (6) which has a hook portion (62) for locking with the complementary connector. The complementary connector includes a dielectric housing (70) which has a flange portion (72) locked with the hook portion of the locking member. The flange portion forms a guide portion (75) guiding and facilitating the hook portion of the locking member to lock with the flange portion during engagement of the cable end connector and the complementary connector.

14 Claims, 7 Drawing Sheets

ELECTRICAL CONNECTOR ASSEMBLY HAVING LOCKING MEMBER

CROSS-REFERENCE TO RELATED APPLICATION

This patent application is a continuation-in-part application of U.S. patent application Ser. No. 10/280,515, filed on Oct. 24, 2002 now U.S. Pat. No. 6,585,537, invented by the same inventor, entitled "CABLE END CONNECTOR WITH LOCKING MEMBER" and assigned to the same assignee as this patent application. All the disclosure of the co-pending application is incorporated herein by reference.

BACKGROUND OF THE INVENTION

1. Field of the Invention

The present invention relates to an electrical connector assembly, and particularly to an electrical connector assembly having a locking member for locking two electrical connectors thereof together.

2. Description of Related Art

Complementary electrical connectors typically include dielectric housings respectively receiving a plurality of terminals or contacts which, when the connectors are mated, establish an electrical interconnection therebetween. The complementary connectors may be male and female connectors or plug and socket connectors for electrically connecting the terminals or contacts received therein. In some instances, the connectors have complementary latches for locking the connectors together when mated. U.S. Pat. Nos. 5,445,534, 5,775,931, 5,924,886 and 6,431,887 disclose different latch structures to provide reliable mechanical and electrical connection between the electrical connectors thereof.

Here exists in the art an electrical connector known as a Serial Advanced Technology Attachment (Serial ATA) connector which is generally used for disk drives and storage peripherals. Especially, the complementary Serial ATA connectors according the Serial ATA standard are featured in fewer electrical contacts than the conventional electrical connectors, i.e., an Ultra ATA connectors, and have a small form factor. It is desirable for the Serial ATA connectors to have a locking member, which can effectively lock the complementary connectors together when mated for thereby providing a reliable mechanical and electrical connection between the complementary connectors.

Hence, a locking member for locking the complementary Serial ATA connectors together is desired.

SUMMARY OF THE INVENTION

An object, therefore, of the present invention is to provide an electrical connector assembly with a locking member for reliably and effectively locking complementary connectors thereof together.

Another object of the present invention is to provide an electrical connector assembly forming a guiding device for facilitating a locking member thereof to lock with a complementary connector.

To fulfill the above objects set forth, an electrical connector assembly in accordance with the present invention comprises a cable end connector and a complementary connector mated with the cable end connector. The cable end connector includes an insulative housing retained with a contact insert, a cover molded with the insulative housing, a cable attached to the cover and electrically connected to the contact insert, and a locking member fastened to the cover and the insulative housing for locking with the complementary connector. The locking member has a hook portion extending out of the insulative housing. The complementary connector includes a dielectric housing and a plurality of terminals for mating with the contact insert of the cable end connector. The dielectric housing has a flange portion locked with the hook portion of the locking member. The flange portion forms a guide portion guiding and facilitating the hook portion of the locking member to lock with the flange portion during engagement of the cable end connector and the complementary connector.

Other objects, advantages and novel features of the invention will become more apparent from the following detailed description when taken in conjunction with the accompanying drawings.

DETAILED DESCRIPTION OF THE INVENTION

Figure 1:
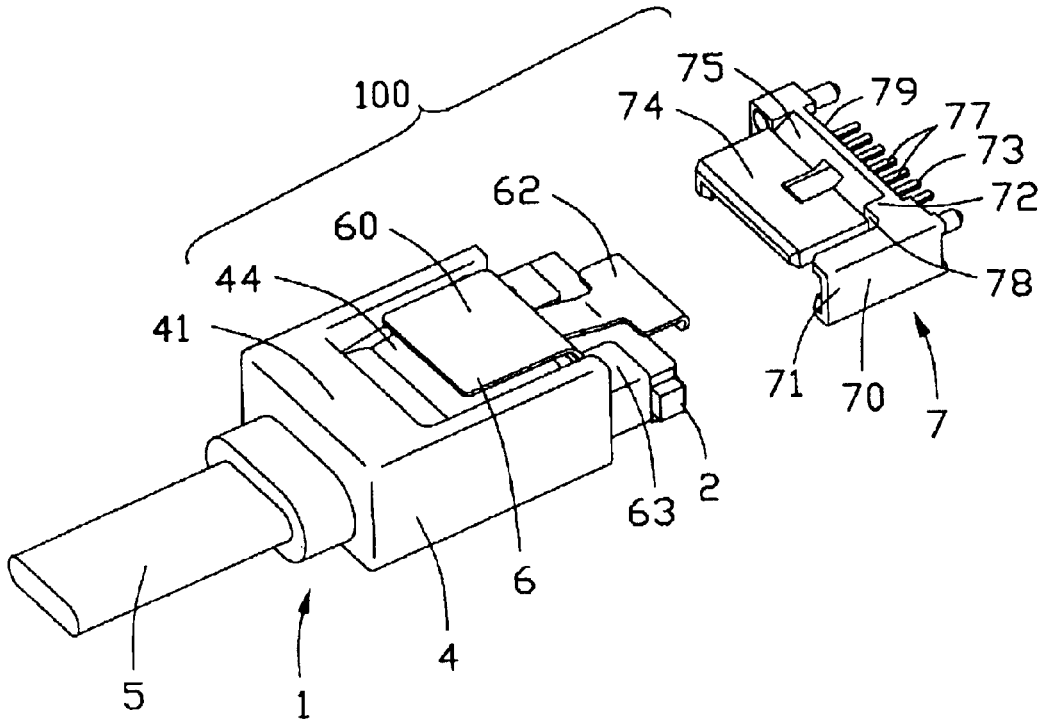
FIG. 1 is an exploded, perspective view of an electrical connector assembly in accordance with a first embodiment of the present invention.
Figure 2:
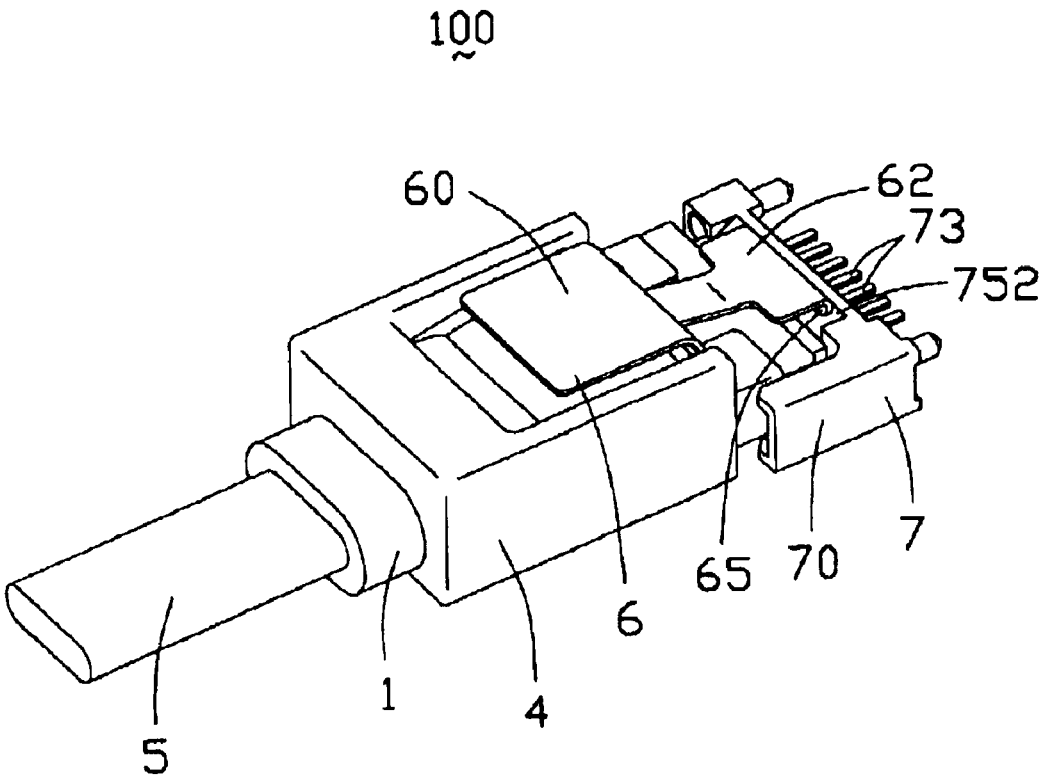
FIG. 2 is an assembled view of FIG. 1 in an early stage.
Figure 3:
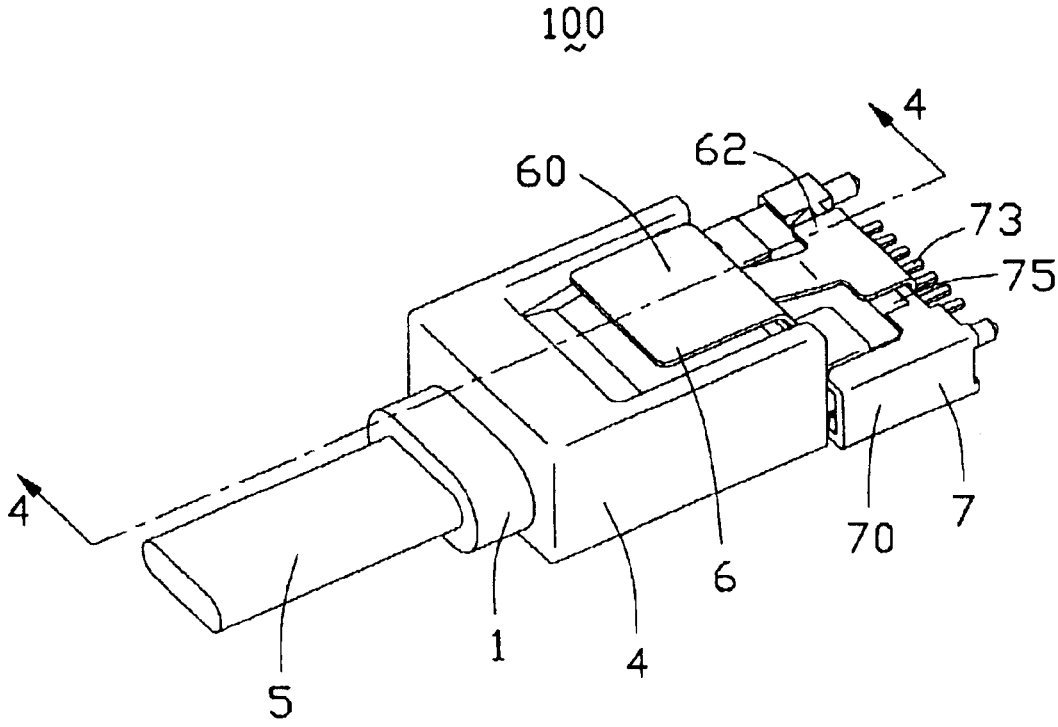
FIG. 3 is an assembled view of FIG. 1 in a final stage.

Referring to FIG. 1, an electrical connector assembly 100 in accordance with the present invention comprises a cable end connector 1 and a complementary connector 7 mated with each other. In the preferred embodiment shown, the cable end connector 1 and the complementary connector 7 are typical standard Serial ATA connectors.

The cable end connector 1 is the same as that disclosed in the co-pending application, and thus, detailed description thereof is omitted hereinafter.

Figure 4:
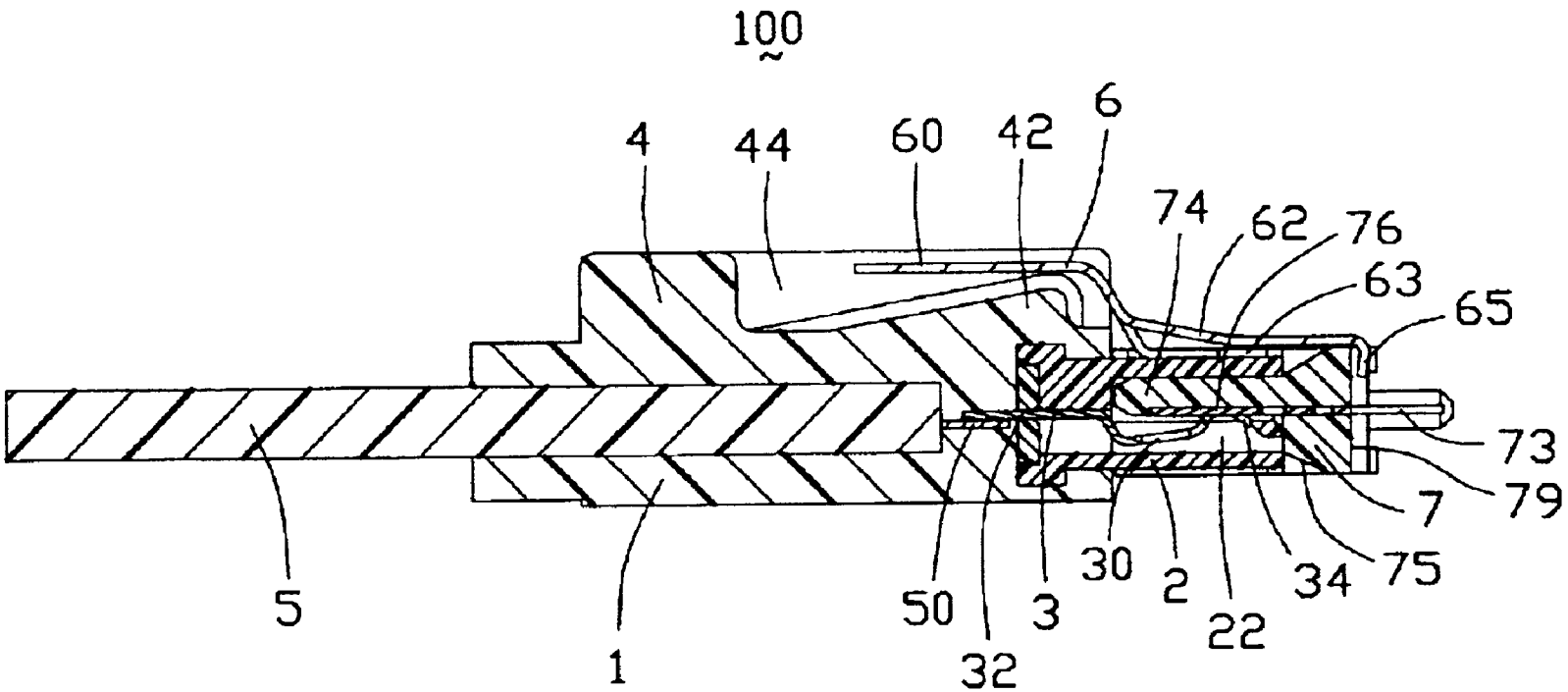
FIG. 4 is a cross-sectional view taken along line 4—4 of FIG. 3.

Further referring to FIG. 4, the cable end connector 1 comprises an insulative housing 2, a contact insert 3 retained in the housing 2, a cover 4 over-molded with the housing 2, a cable 5 fastened to the cover 4 opposite to the housing 2, and a locking member 6. The housing 2 further defines a receiving space 22 in a rear end thereof. The cover 4 defines a recess 44 in a top face 41 thereof and forms a fulcrum portion 42 in the recess 44. The cable 5 includes a plurality of conductive conductors 50 (only one shown) and each conductor 50 is electrically connected to one end 32 of a corresponding contact 30 of the contact insert 3. The locking member 6 comprises a pushed portion 60 mounted on the fulcrum portion 42 and the pushed portion 60 is rotatable in the recess 44 about the fulcrum portion 42. A pair of securing portions 63 and a hook portion 62 between the securing portions 63 extend from the pushed portion 60. The securing portions 63 are respectively wrapped around both lateral sides of the housing 2 to retain the locking member 6 in position. The hook portion 62 forms a vertical hook 65 at a free end thereof to hook with the complementary connector 7.

Referring to FIGS. 1 and 4 again, the complementary connector 7 is similar to that disclosed in the co-pending application and includes a dielectric housing 70, a plurality of terminals 73 retained in the housing 70. The dielectric housing 70 has a flange portion 72 and a tongue 74 extending forward from the flange portion 72. A guide post 71 is formed at one lateral side of the flange portion 72 for guiding the cable end connector 1 to engage with the complementary connector 7. Additionally, a pair of guide portions 75 is formed in a front face 78 of the flange portion 72 and each is chamfered in configuration and has an inclined surface 752, functioning as guiding and facilitating the vertical hook 65 of the locking member 6 to lock with the complementary connector 7, which will be more detailedly illustrated below. The flange portion 72 further has a vertically flat rear face 79 opposite to the guide portion 75 for locking with the vertical hook 65 of the locking member 6. Furthermore, in accordance with the first preferred embodiment of the present invention, the terminals 73 each have a mating end 76 for conductively contacting another end 34 of a corresponding contact 30 of the cable end connector 1 and a solder tail 77 in Through Hole (T/H) type to be soldered to a corresponding hole defined in a circuit board (not shown).

In assembly, referring to FIGS. 1 to 4, the cable end connector 1 is inserted toward the complementary connector 7. The tongue 74 retained with the terminals 73 aligns with and is inserted toward the receiving space 22 of the housing 2 of the cable end connector 1. Meanwhile, the vertical hook 65 of the locking member 6 slides on the inclined surface 752 of the guide portion of the complementary connector 7 and then snapped onto the rear face 79 of the flange portion 72. Thereby, the locking member 6 of the cable end connector 1 is smoothly and securely locked with the flange portion 72 the complementary connector 7. On the other hand, when the cable end connector 1 is desired to be detached from the complementary connector 7, push the pushed portion 60 of the locking member 6 downward with respect to the fulcrum portion 42 of the cover 4 so that the vertical hook 65 is rotated upward to escape from the complementary connector 7. Thus, the cable end connector 1 is detached from the complementary connector 7.

Figure 5:
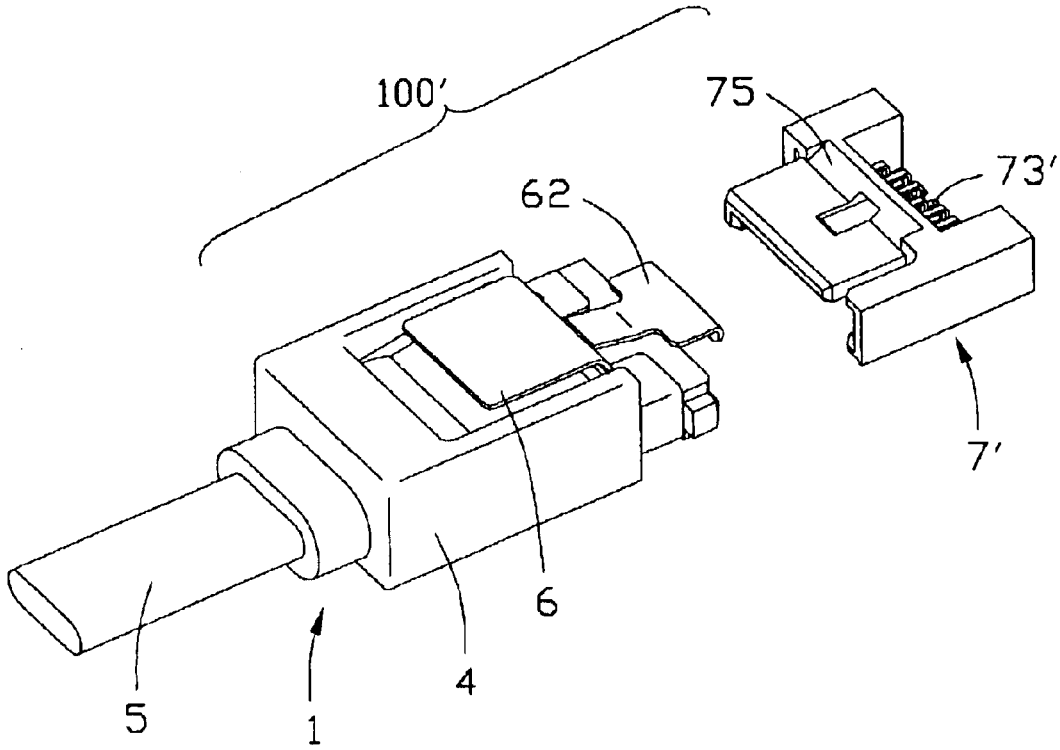
FIG. 5 is an exploded, perspective view of an electrical connector assembly in accordance with a second embodiment of the present invention.
Figure 6:
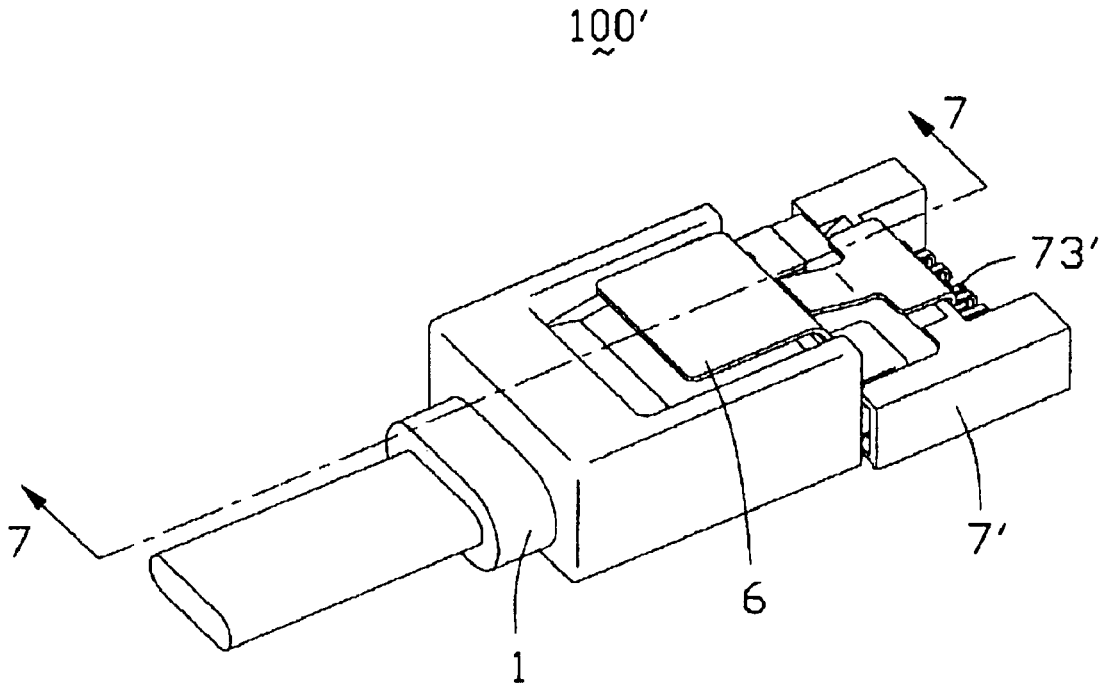
FIG. 6 is a fully assembled view of FIG. 5.
Figure 7:
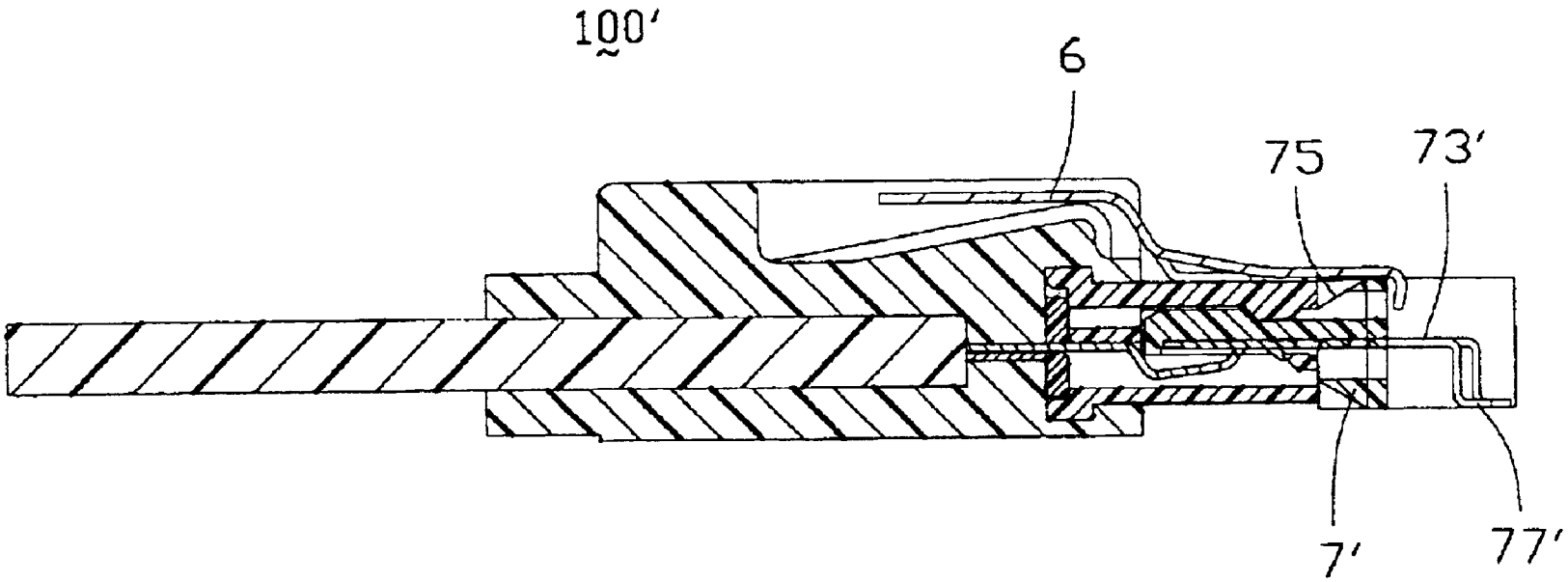
FIG. 7 is a cross-sectional view taken along line 7—7 of FIG. 6.

Further referring to FIGS. 5 to 7, an electrical connector assembly 100' in accordance with a second embodiment of the present invention is shown and includes a cable end connector 1 identical to that of the first embodiment of the present invention, and a complementary connector 7' similar to that of the first embodiment. It is noted that the complementary connector 7' also forms a pair of guide portions 75 at the flange portion 72 thereof for facilitating movement of the locking member 6 of the cable end connector 1 on the complementary connector 7' when the cable end connector 1 is inserted toward the complementary connector 7' to connect therewith. The main difference between the complementary connectors 7 and 7' is that the former has terminals 73 with T/H types of solder tails 77 while the later has terminals 73' with SMT (Surface Mounting Technology) solder tails 77'. That is, the terminal 73' has a horizontal solder tail 77' to be soldered to a top surface of a circuit board (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a cable end connector including, an insulative housing retained with a contact insert, a cover molded with the insulative housing, a cable attach to the cover and electrically connected to the contact insert, and a locking member fastened to the insulative housing and pivotally mounted on the cover, and having a hook portion extending out of the insulative housing; and a complementary connector engaged with the cable end connector and including a dielectric housing and a plurality of terminals retained to the dielectric housing and mating with the contact insert of the cable end connector, the dielectric housing forming a flange portion engaged with the hook portion of the locking member of the cable end connector and a tongue portion extending forwardly from the flange portion, the flange portion forming a guiding portion on a rear end of the tongue portion for guiding and facilitating the hook portion of the locking member to lock with the flange portion during engagement of the cable end connector and the complementary connector.

2. The electrical connector assembly as claimed in claim 1, wherein the locking member comprises a push portion rotatably mounted on the cover and a securing portion extending from the push portion and wrapped around one lateral side of the insulative housing.

3. The electrical connector assembly as claim in claim 2, wherein the hook portion is adjacent to the securing portion and forms a vertical hook hooking a rear face of the flange portion of the complementary connector.

4. The electrical connector assembly as claimed in claim 3, wherein the guide portion is a chamfer defined in a front face of the flange portion opposite to the rear face of the flange portion, and has an inclined surface.

5. The electrical connector assembly as claimed in claim 4, wherein the vertical hook of the locking member firstly slides on the inclined surface of the guide portion and then snapped onto the rear surface of the flange portion of the complementary connector when the cable end connector is moved to connect with the complementary connector.

6. The electrical connector assembly as claimed in claim 1, wherein each terminal of the complementary connector has a solder tail of Trough Hole (T/H) type for being soldered to a circuit board.

7. The electrical connector assembly as claimed in claim 1, wherein each terminal of the complementary connector has a solder tail of Surface Mounting Technology (SMT) type for being soldered to a circuit board.

8. An electrical connector assembly comprising:

a first electrical connector for being mounted on a circuit board; and a second electrical connector having a locking member locking with the first electrical connector; wherein the first electrical connector forms a flange portion, a tongue portion extending forwardly from the flanged portion and a chamfered guide portion on a rear end of the tongue portion for guiding and facilitating the locking member to lock with the first electrical connector.

9. The electrical connector assembly as claimed in claim 8, wherein the locking member forms a hook portion hooked with the first electrical connector.

10. The electrical connector assembly as claimed in claim 8, wherein the flange portion has opposite front and rear faces.

11. The electrical connector assembly as claim in claim 10, wherein the chamfered guide portion is defined in the front face of the flange portion and has an inclined surface on which the hook portion of the locking member slides before the locking member fully locks with the first electrical connector.

12. The electrical connector assembly as claimed in claim 10, wherein the hook portion of the locking member is locked with the rear face of the flange portion.

13. An electrical connector assembly comprising:

a cable connector including:

an insulative first housing defining a mating cavity with therein a plurality of first contacts extending along a lengthwise direction;

a locking member extending along said lengthwise direction and being pivotal relative to the first housing with a hook at a free distal end thereof;

a complementary connector including:

a second housing mounted on a printed circuit board with a mating tongue extending along said lengthwise direction, said mating tongue defining opposite first and second faces thereon;

an engagement flange formed on the second housing opposite to the mating tongue;

a guiding portion formed between the second face of the mating tongue and the locking face of the engagement flange;

wherein during mating, the hook initially moves along the second face of the mating tongue in said lengthwise direction, and is successively forcibly deflected by the guiding portion in an outward direction perpendicular to said lengthwise direction to have the hook automatically sprung outwardly and over the engagement flange and finally abut against a locking face of the engagement flange.

14. The electrical connector assembly as claimed in claim 13, wherein said outward direction is perpendicular to a lateral direction along with the first contacts are spaced arranged with one another.

* * * * *